US009677234B2

(12) United States Patent
Wynnytsky et al.

(10) Patent No.: US 9,677,234 B2
(45) Date of Patent: Jun. 13, 2017

(54) VEHICLE CATCH SYSTEMS AND METHODS

(71) Applicant: Engineered Arresting Systems Corporation, Aston, PA (US)

(72) Inventors: Sofia Wynnytsky, Philadelphia, PA (US); Mark Slimko, Crystal Lake, IL (US); Reggie Torrez, Media, PA (US); Robert Withers, Media, PA (US); Hugh K. Delong, III, Jeffersonville, PA (US); Danny Warrick, Philadelphia, PA (US); Kirk F. Schneider, Springfield, PA (US); Thomas H. Ross, St. Davids, PA (US); Marcos Villa-Gonzales, Cherry Hill, NJ (US); Dennis Page, Shillington, PA (US); John Patrick McGinley, Scottsdale, AZ (US); Peter T. Mahal, Berwyn, PA (US); Richard L. Orner, Jr., Oreland, PA (US)

(73) Assignee: Engineered Arresting Systems Corporation, Aston, PA (US)

( * ) Notice: Subject to any disclaimer, the term of this patent is extended or adjusted under 35 U.S.C. 154(b) by 1108 days.

(21) Appl. No.: 13/647,070

(22) Filed: Oct. 8, 2012

(65) Prior Publication Data

US 2013/0126810 A1 May 23, 2013

Related U.S. Application Data

(60) Provisional application No. 61/563,343, filed on Nov. 23, 2011.

(51) Int. Cl.

| | |
|---|---|
| ***E01F 15/00*** | (2006.01) |
| ***E01F 15/14*** | (2006.01) |
| ***E01F 15/06*** | (2006.01) |

(52) U.S. Cl.
CPC ..... *E01F 15/145* (2013.01); *E01F 15/06* (2013.01); *E01F 15/065* (2013.01)

(58) Field of Classification Search
CPC ..... E01F 15/06; E01F 15/065; E01F 15/45
(Continued)

(56) References Cited

U.S. PATENT DOCUMENTS 1,449,518 A * 3/1923 Lawson ..... E01F 15/0438 256/1
2,189,974 A * 2/1940 Buford ..... B61L 29/023 14/52

(Continued)

FOREIGN PATENT DOCUMENTS

AT WO 2006089321 A1 * 8/2006 ..... E01F 15/043
CA 2406361 A1 4/2004

(Continued)

OTHER PUBLICATIONS

China Patent Application No. 201280057548.9, Office Action (and English translation) dated Jun. 30, 2015.

(Continued)

*Primary Examiner* — Gregory Binda
*Assistant Examiner* — Nahid Amiri
(74) *Attorney, Agent, or Firm* — Kilpatrick Townsend & Stockton LLP; Dean W. Russell; Kristin M. Crall

(57) ABSTRACT

Vehicle restraints and fence systems that offer better protection to the driver and vehicle in the event of an accident where the car becomes airborne and leaves the road or track, and catch fences for halting the overrun of a car leaving a racetrack. The catch fences may have pivotable poles and a cable extending between the poles. Net or fencing is installed between the poles, supported by the cable. The poles may be angled or curved, with a plurality of cables extending therebetween or with a net extending from the (Continued)

poles and attached to a Steel and Foam Energy Reduction barrier.

10 Claims, 15 Drawing Sheets

(58) Field of Classification Search
USPC ..... 256/1, 13.1, 65.14; 404/6, 9
See application file for complete search history.

(56) References Cited

U.S. PATENT DOCUMENTS

| | | | | |
|---|---|---|---|---|
| 2,518,004 | A * | 8/1950 | Greenwell | E01F 15/06 248/66 |
| 3,367,608 | A * | 2/1968 | Charno | B64F 1/02 244/110 R |
| 4,673,166 | A * | 6/1987 | MacDougall | E04H 17/02 256/1 |
| 4,685,656 | A * | 8/1987 | Lee | E01F 15/025 256/13.1 |
| 4,743,015 | A * | 5/1988 | Marshall | A63B 21/00072 482/112 |
| 4,824,282 | A * | 4/1989 | Waldecker | E01F 13/046 404/6 |
| 6,726,400 | B1 | 4/2004 | Angley et al. | |
| 6,766,607 | B2 * | 7/2004 | Castaldo | F41J 11/00 42/98 |
| 6,971,817 | B2 | 12/2005 | Allen et al. | |
| 7,261,490 | B2 | 8/2007 | Allen et al. | |
| 7,347,147 | B2 * | 3/2008 | Bar | F42B 10/50 102/473 |
| 7,410,320 | B2 * | 8/2008 | Faller | E01F 15/145 404/6 |
| 7,467,909 | B2 | 12/2008 | Orner, Jr. et al. | |
| 7,597,502 | B2 | 10/2009 | Allen et al. | |
| 7,815,392 | B2 * | 10/2010 | Kwasny | E01F 15/083 404/6 |
| 7,837,409 | B2 | 11/2010 | Mahal et al. | |
| 7,942,602 | B2 * | 5/2011 | Bunk | E01F 13/028 256/13.1 |
| 8,007,198 | B1 | 8/2011 | La Valley et al. | |
| 8,021,074 | B2 | 9/2011 | Valentini et al. | |
| 8,021,075 | B2 | 9/2011 | Valentini et al. | |
| 8,172,707 | B2 * | 5/2012 | Cox | A63B 61/02 473/416 |
| 8,224,507 | B2 | 7/2012 | Edwards et al. | |
| 2005/0116481 | A1 * | 6/2005 | Blahut | B60R 19/16 293/17 |
| 2008/0014019 | A1 | 1/2008 | Allen et al. | |
| 2010/0143033 | A1 | 6/2010 | Metzger | |
| 2010/0202829 | A1 * | 8/2010 | Gelfand | E01F 13/12 404/6 |
| 2011/0020062 | A1 | 1/2011 | Mahal et al. | |
| 2011/0177933 | A1 | 7/2011 | Valentini et al. | |
| 2011/0305530 | A1 * | 12/2011 | Hunt | E02B 3/04 405/302.7 |

FOREIGN PATENT DOCUMENTS

| | | | | |
|---|---|---|---|---|
| CN | 1643221 | A | 7/2005 | |
| CN | 201033863 | Y | 3/2008 | |
| DE | 2457929 | A1 | 6/1976 | |
| DE | 29600444 | U1 | 2/1996 | |
| DE | 20119635 | U1 | 3/2002 | |
| DE | 20218419 | U1 | 2/2003 | |
| DE | WO 2011101157 | A1 * | 8/2011 | A01K 3/00 |
| JP | S37-027135 | | 1/1962 | |
| JP | S52-021166 | | 9/1978 | |
| JP | S60-242876 | | 12/1985 | |
| JP | H02-016208 | A | 1/1990 | |
| JP | 07172312 | A * | 7/1995 | |
| WO | 2006089321 | A1 | 8/2006 | |

OTHER PUBLICATIONS

Singapore Patent Application No. 11201402552T, Written Opinion and Search Report dated May 18, 2015.

Europe Patent Application No. 12787191.1, Examination Report dated Sep. 17, 2015.

International Preliminary Report on Patentability dated Jun. 5, 2014 in Application No. PCT/US2012/059269.

International Search Report and Written Opinion dated Feb. 13, 2013 in Application No. PCT/US2012/059269.

Singapore Patent Application No. 11201402552T, Written Opinion dated Mar. 21, 2016.

Japan Patent Application No. 2014-543472, Examination Report (and English translation) mailed Jul. 5, 2016.

Australia Patent Application No. 2012341051, Examination Report mailed Aug. 8, 2016.

Europe Patent Application No. 12787191.1, Examination Report mailed Aug. 25, 2016.

Singapore Patent Application No. 11201402552T, Written Opinion dated Oct. 26, 2016.

Japan Patent Application No. 2014-543472, Decision to Grant a Patent (and English translation) dated Dec. 6, 2016.

* cited by examiner

VEHICLE CATCH SYSTEMS AND METHODS

CROSS REFERENCE TO RELATED APPLICATIONS

This application claims the benefit of U.S. Provisional Application Ser. No. 61/563,343, filed Nov. 23, 2011, titled "Vehicle Catch Fence," the entire contents of which are hereby incorporated by reference.

FIELD OF THE INVENTION

Embodiments of the present invention relate generally to catch systems for vehicles leaving a road, highway, track, platform, or surface at an accelerated pace. For example, the catch systems and methods may be used on a racetrack to help prevent a car crash from becoming even more dangerous to the car driver, as well as to the spectators at the track. The catch system may be used to more safely decelerate the vehicle's motion than a hard wall, while also preventing the car from continuing on its course of travel into the stands or stadium. Additionally or alternatively, the catch systems and methods may be used on any motor sports facilities, motocross sidelines, motorcycle or car demonstrations, on circus sidelines, for boat or other water craft races or demonstrations, highways, or any other instance when fast moving or otherwise motorized vehicle may become a dangerous projectile.

BACKGROUND

There is a need for racetrack compliant fences. Fatal crashes, particularly for Indy car drivers, have brought this need to the forefront in recent years. Currently, race track walls are manufactured of cement, which does not cushion or absorb any kinetic energy of a moving object. The fences and fence posts that rise above track walls are similarly inflexible. Accordingly, the present inventors have sought to develop an energy absorbing fence.

Energy-absorbing barriers have been used in connection with airport runways, and these barriers are designed to stop an aircraft that is overrunning a runway, but to do so in a manner that safely halts the vehicle's movement while not injuring passengers and personnel. Examples of aircraft and other vehicle halting systems are described in many of the assignee's patents and patent applications, including U.S. Pat. Nos. 6,726,400; 6,971,817; 7,261,490; 7,467,909; 7,597,502; 7,837,409; 8,007,198; 8,021,074; 8,021,075; 8,224,507 and U.S. Patent Publication Nos. 2008/0014019; 2011/0020062; and 2011/0177933. For example, in addition to systems designed to stop overrun aircraft, other energy-absorbing walls have been considered for use in highway situations as well, in order to stop a car from leaving the highway at a dangerous pace, but to also stop the car without injuring its occupants. Further improvements to catch fences, however, are needed, particularly for high speed crashes, such as those occurring at speedways or racetracks.

BRIEF SUMMARY

Embodiments of the invention described herein thus provide vehicle catch fence systems and methods to be used at motorsports facilities and other venues where vehicle projectile safety is concerned. They are generally intended to be used in place of rigid fencing that is widely installed to contain airborne race cars or other vehicles and keep them from leaving the racetrack and endangering spectators behind the fences. Current fences are a hazard to drivers because of their rigidity and tendency to cause severe damage to the car if it strikes the fencing material.

Some of the embodiments described herein move the rigid poles and other unforgiving materials back from the outer edges of the race track and provide some cushioning and catching effect before the car encounters any fixed objects. The catch systems may be designed at various angles, they may be installed in multiple sections, they may be designed to catch and cushion multiple cars or vehicles, and may have various other features described below. The general intent was to develop a compliant fence system that offers better protection to the driver and the car in the event of an accident where the car becomes airborne and leaves the track.

DETAILED DESCRIPTION

Embodiments of the present invention provide various embodiments for catch fence systems and methods. Although the embodiments described herein may be used in various venues, they are described in connection with a race track for ease of explanation. However, it should be understood that the catch systems and methods described herein may be useful in any other circumstance when a motorized vehicle is to be stopped safely and effectively.

Figure 1:
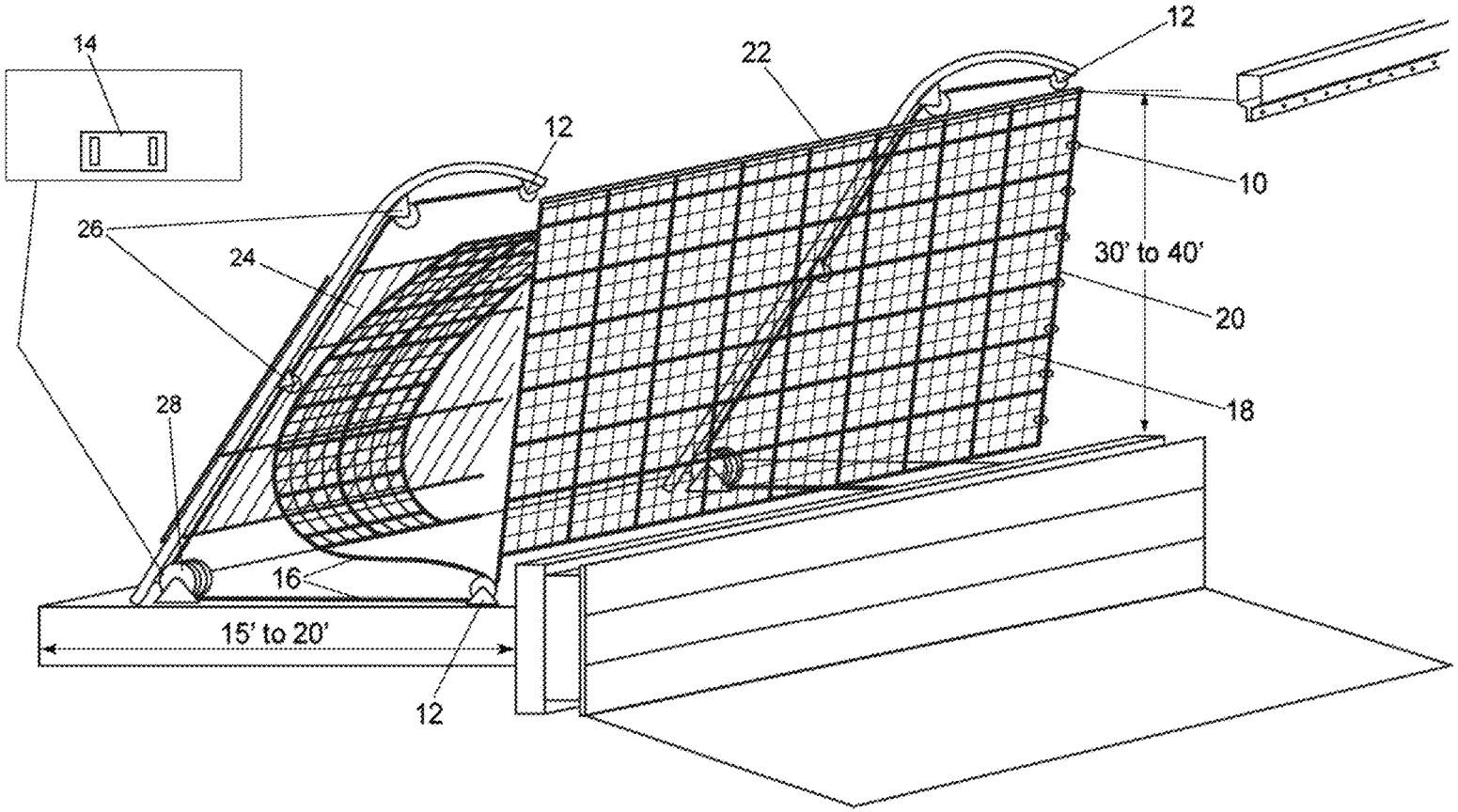
FIG. 1 shows a schematic of a first catch fence embodiment.

In one embodiment, the fence poles are moved back from the edge of the race track, and they support a catch net and energy absorbers to absorb the energy of cars that have left the racetrack and become airborne. An example of such a system is shown in FIG. 1. This fence is designed to be engaged at an oblique angle. It can engage multiple cars, which is necessary, as cars are typically made airborne from multiple car contacts in a single crash. The fence is designed to be installed in sections that are temporarily connected to each other (side by side) so that one section engaged will absorb energy while an adjacent section (or sections) remains in place and ready to catch other cars.

In the embodiment shown in FIG. 1, the net sections are divided by break-away C-clips 10 that allow one section to detach from its neighbor section so that only the section that is needed is utilized. The fence also uses pivoting pulleys 12 with a friction brake system 14 mounted on the ground. The friction braking on the back pulleys particularly allows for softening the impact and can let out cable 16 as needed. The top pulleys may rotate to guide the cable where it is needed most. Secured by the pulleys is a catch netting. In the figure shown, the netting is designed as nylon netting 18 with nylon straps 20, but it should be understood that any appropriate net material may be used, as long as it contains sufficient strength properties. It is shown that the net may be 30-40 feet high, but it should be understood that lower fences may be more realistic in practice, and as such, the fence may be up to 20 feet instead. FIG. 1 also shows a flexible steel nylon strap holder 22. A secondary safety steel mesh catch fence 24 is provided as a back-up barrier to prevent debris from entering the spectator seating areas. The system is designed for high speed, short run outs, as compared to traditional road barriers that are designed for lower speeds and longer run outs. It is desirable that repair to a utilized fence section can be conducted quickly (e.g., in approximately 20 to 30 minutes and possibly less), to allow a race to continue after a catching incident. FIG. 1 further shows guide pulleys 26 and pulleys with a low profile friction brake 28.

In improving upon this fence design, further considerations were to construct a simpler fence, which could render it easier to accept by the industry, as well as easier to install at a particular venue. Additionally, although safety is of particular concern, it is also desirable to not limit spectator sight lines, where possible. The space availability between the existing track wall and the grandstands is also different at every track, so it is desirable that the catch solution be modular and adjustable. Further, rapid system reset after an accident is an additional important consideration. Although not wishing to be bound to the following data, the following table provides the estimated magnitude of the forces involved in typical racetrack crashes and indicates the power that the catch systems are designed to contain. (Note that these are energies involved with straight-line impacts, and could be considered worst-case scenarios.) The magnitudes of force to be contained and thus designed around are shown below.

TABLE 1

Racetrack Crash Force Data

| Car Type | Vehicle Weight (lbs) | Approximate Crash Speed to Consider (mph) | Run-out (ft) | Kinetic Energy (ft-lbf) | Force (lbf) | Max Decel-eration (g's) |
|---|---|---|---|---|---|---|
| NASCAR | 3,400 | 120 | 25 | 1,636,692 | 64,468 | 19.3 |
| IRL | 1,800 | 180 | 25 | 1,949,589 | 77,984 | 43.3 |
| Sprint | 900 | 90 | 20 | 243,699 | 12,185 | 13.5 |

C-Fence.

Figures 2A, 2B, 2C:
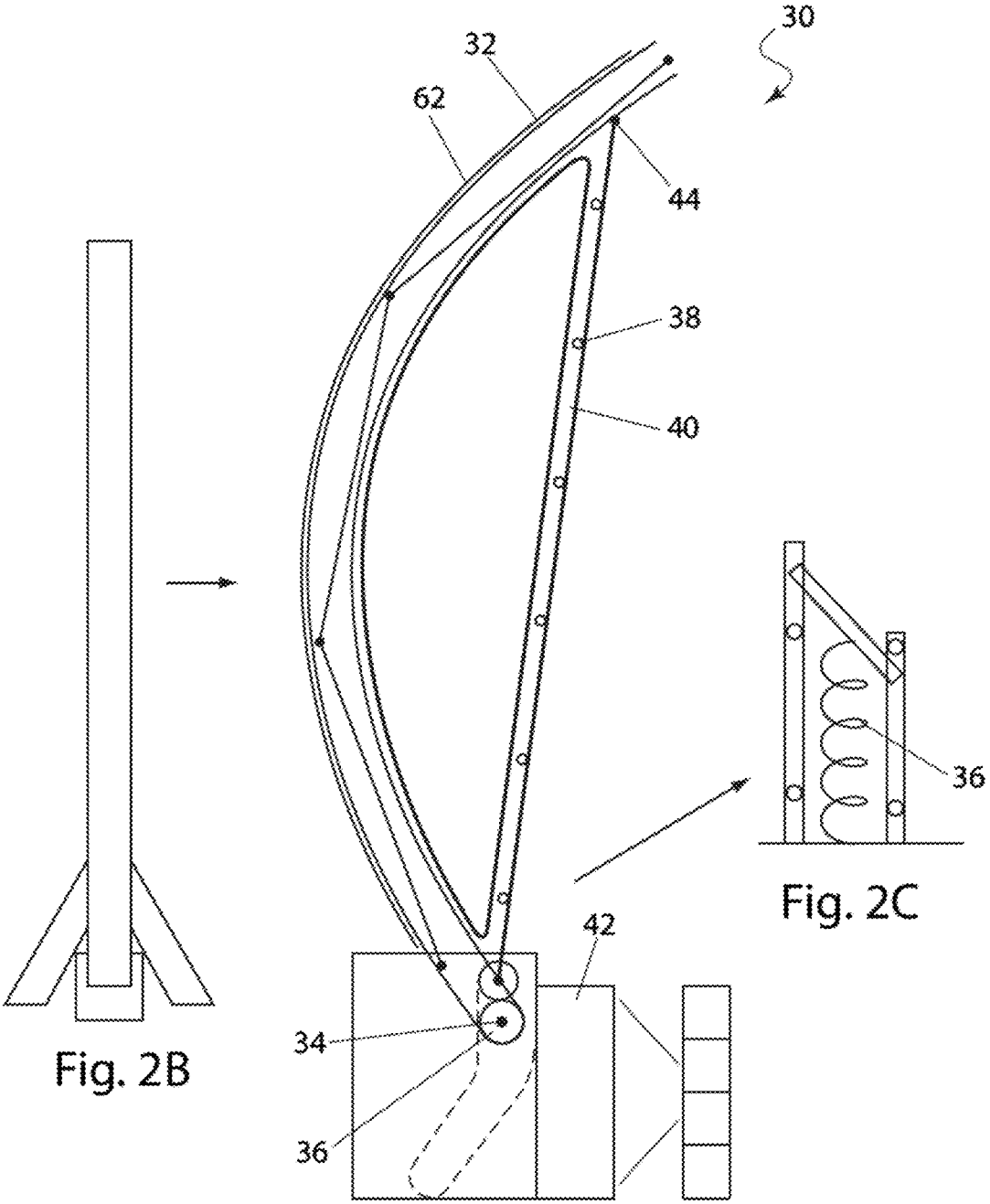
FIGS. 2-4 illustrate a C-fence catch fence embodiment.
Figure 4:
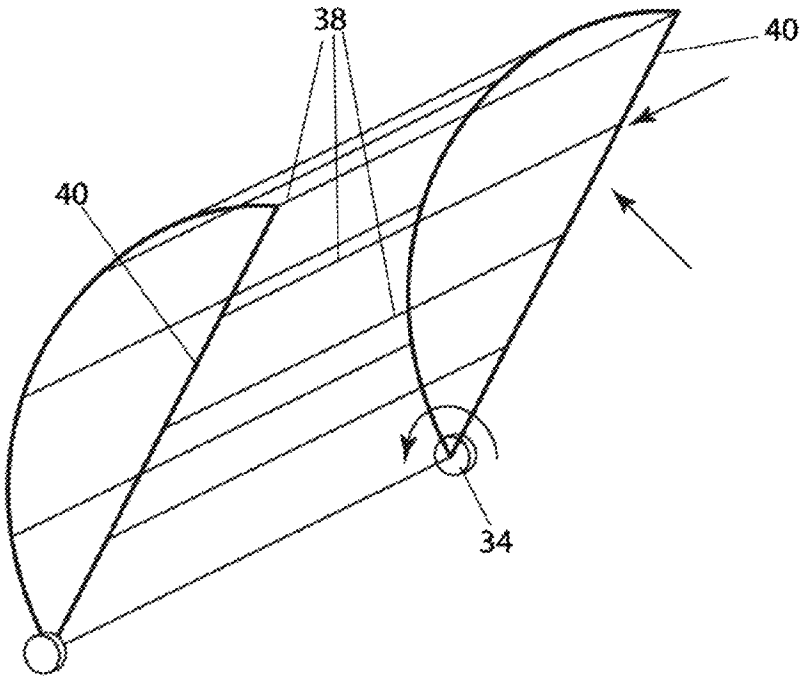
Figure 3:
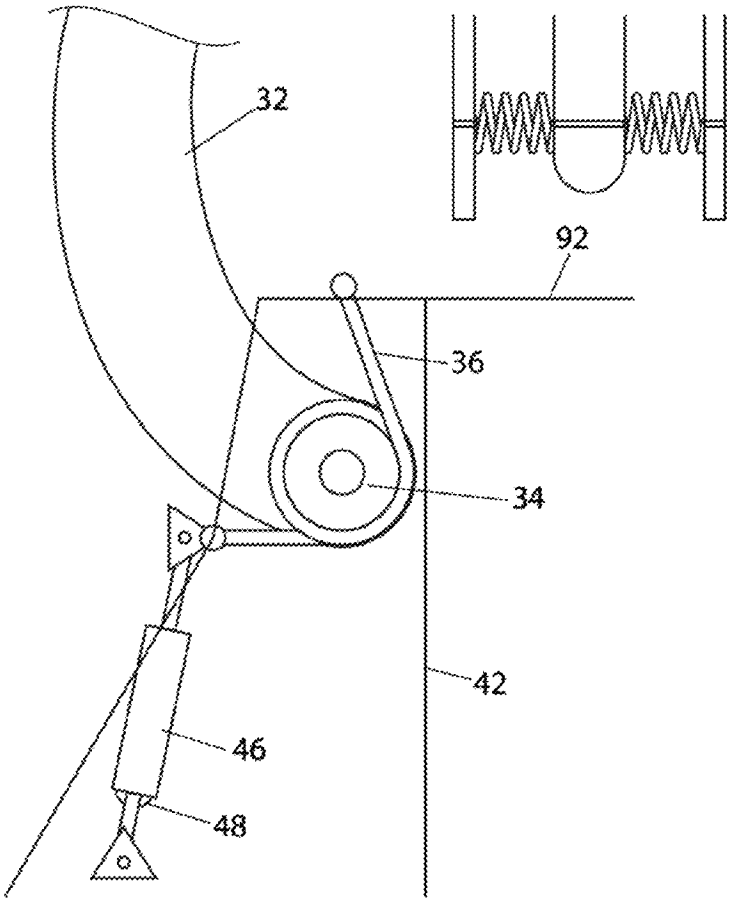

A further embodiment of a catch fence system and method is referred to as the C-fence 30, and is shown in FIGS. 2-4. The C-fence concept involves "C" shaped poles 32 that connect at their bottom to the back of the existing racetrack wall at a pivot joint 34. The tops of the poles are free to pivot away from the track during an impact. Each pole is connected to a large torsion spring 36 or hydraulic cylinder at the bottom joint to dissipate energy. The main cables 38 are suspended between the poles on vertical cables 40 that run between the top and bottom of each "C" pole. The smaller mesh debris fencing may be installed along the back side of the "C" frame, or it could be integrated with the main cables out at the "C" opening. An anchor plate 42 may secure the net in place. An anchor point 44 may secure the vertical cable 40 in place with respect to the pole 32. FIG. 2A shows a side plan view. FIG. 2B shows a rear view of the FIG. 2A. FIG. 2C shows a close view of the torsion spring 36 of FIG. 1A.

FIG. 3 shows a side plan view of the lower portion of the C-fence. The anchor plate features a damper 46 and a bump stop 48.

Advantages of the C-fence include that the concrete wall at tracks is a consistent feature to build off of, so it is a stable solution. The C-fence also does not take up valuable real estate, and it is considered to have a potentially simple, inexpensive construction. It can also be installed without major construction changes to the facility, and it eliminates poles from impact area.

Leaf-Spring.

Figure 5:
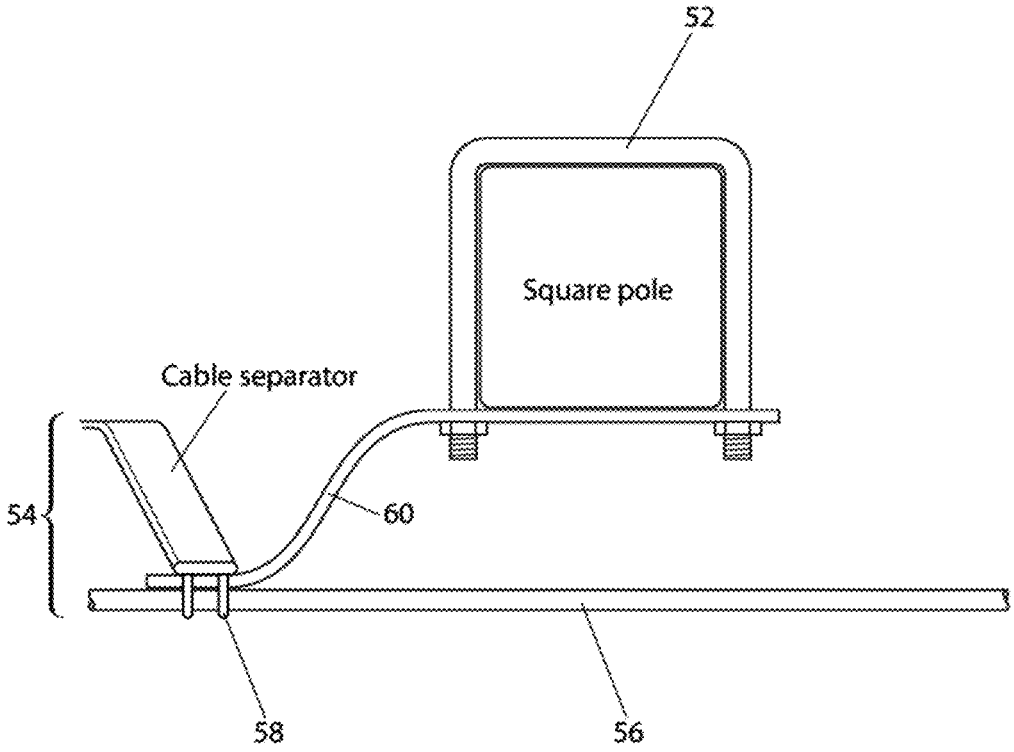
FIGS. 5-9 illustrate a leaf spring catch fence embodiment.
Figure 6:
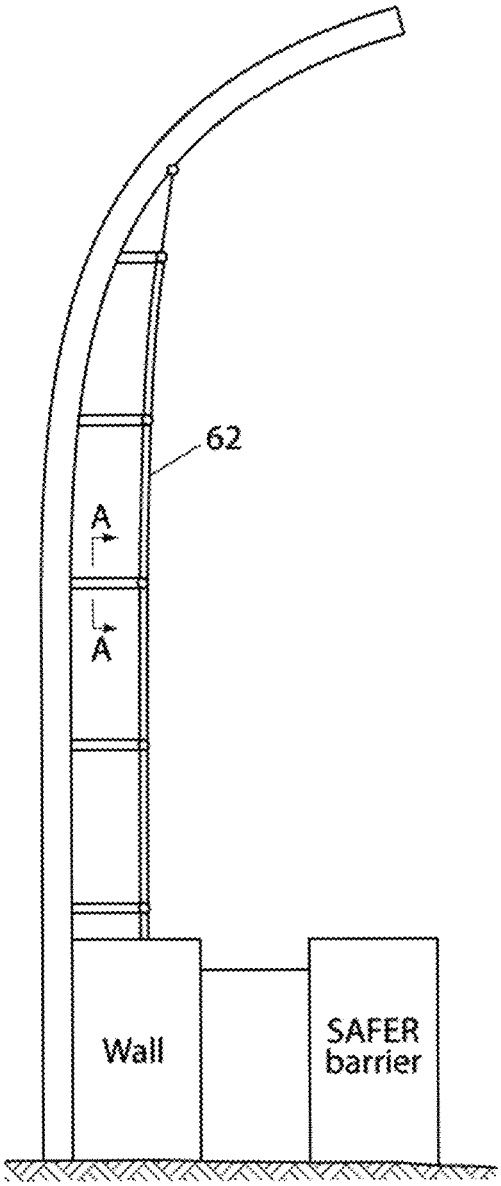
Figure 6A:
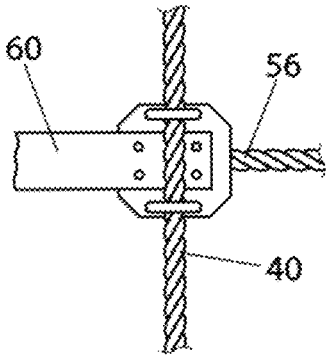
Figure 7:
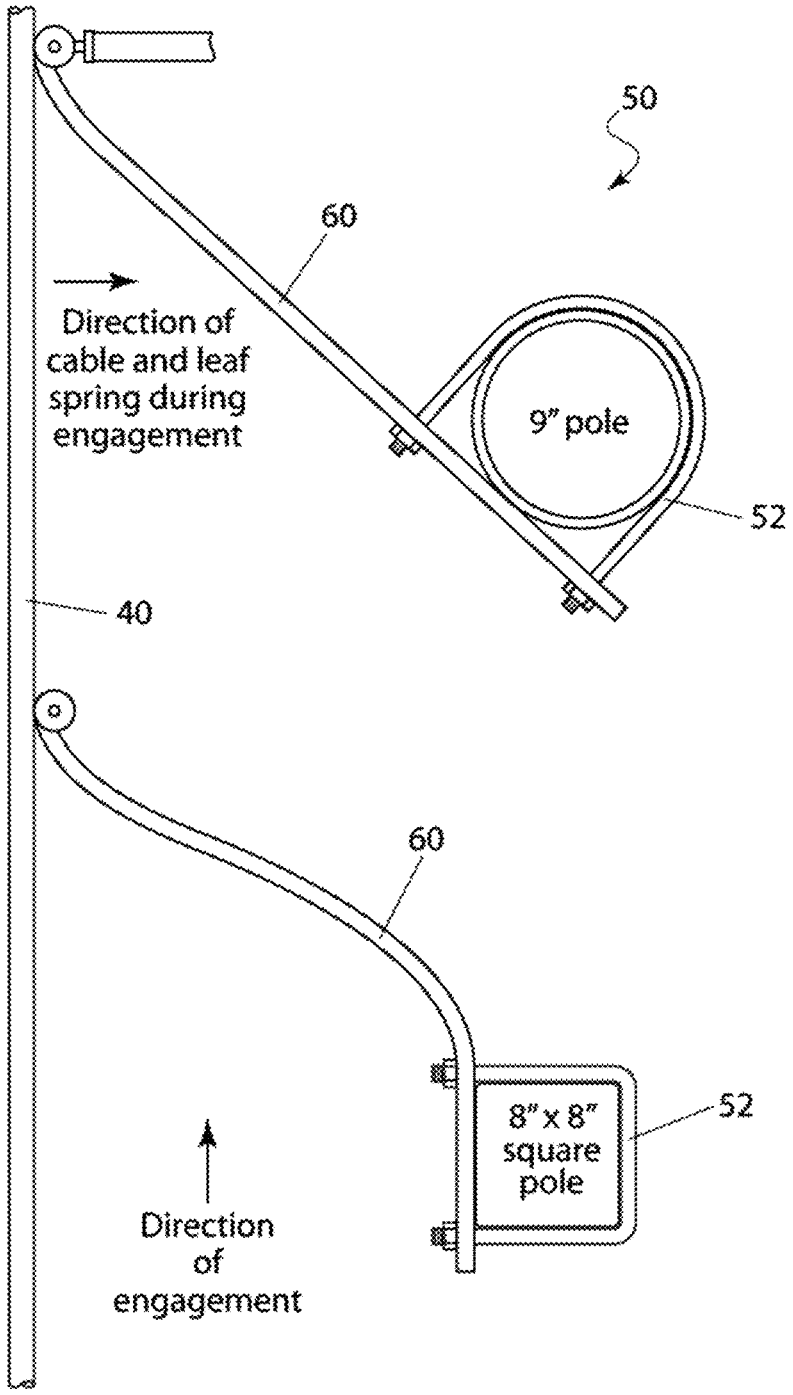
Figure 8:
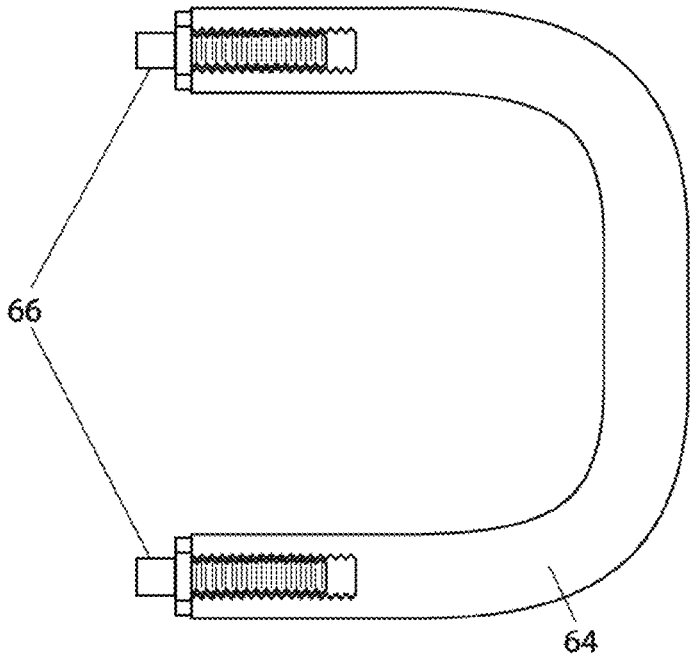

A further embodiment is the Leaf Spring fence 50, shown in FIGS. 5-9. The Leaf Spring concept involves a simple way to "re-mount" and suspend the main safety cables of a fencing system off of the existing support poles. Without wishing to be bound by any theory, it is believed that by moving the support cables off of the poles by some distance, more clearance can be created in front of the poles in situations where the driver's side of the car contacts the catch fence. A "U" shaped bracket 52 (it could be square or round, depending on the pole style in use) is mounted to the existing upright, and it is used in turn to mount a leaf spring assembly 54. The leaf spring assembly 54 contains the cable 56 via a sliding connection 58 at its end, so that in the event of a crash, the leaf spring 60 would flex while riding along the length of the cable 56. The leaf spring 60 provides energy absorption at the pole. The main safety cables would be spaced via a simple "U" shaped bracket 52 that also ties the ends of the leaf springs 60 together. The leaf springs 60 could be fabricated straight and be mounted to the pole at an angle, or they could be fabricated "S" shaped and be mounted parallel to the track wall, as shown in FIG. 5. FIG. 6 illustrates a side view of the leaf spring concept. FIG. 6A illustrates a cross-section along the line A-A in FIG. 6. In FIG. 6A, the leaf spring 60 is mounted with respect to the vertical support cable 40 as well as the horizontal cable 56. FIG. 6 also illustrates mesh 62 supported by the cables. FIGS. 7-9 illustrate further views of the leaf spring concept and show details of the leaf spring connection to the pole. FIG. 7 illustrates a side view of the leaf spring fence 50. It illustrates various examples of leaf spring to pole connections.

Figure 9A:
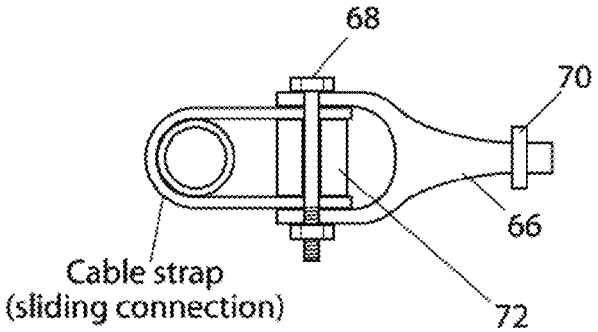
Figure 9B:
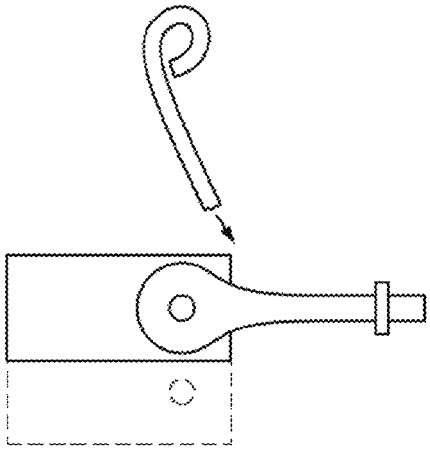

FIG. 8 illustrates a cable separator 64 and cable separator connections 66. FIG. 9A illustrates a side view of connections 66, including a through bolt 68, a tightening bolt 70, an eye 72 at the end of the leaf spring, and a cable strap (sliding connection) 74. FIG. 9B illustrates a top view of connections 66.

Potential advantages of the leaf spring concept are that is provides a relatively simple and elegant design, it is retrofittable, it can be implemented with a low cost, it can be designed to be self-resetting, it requires minimal changes to existing infrastructure such that it can work with existing fencing components.

Catch Net.

Figure 10A:
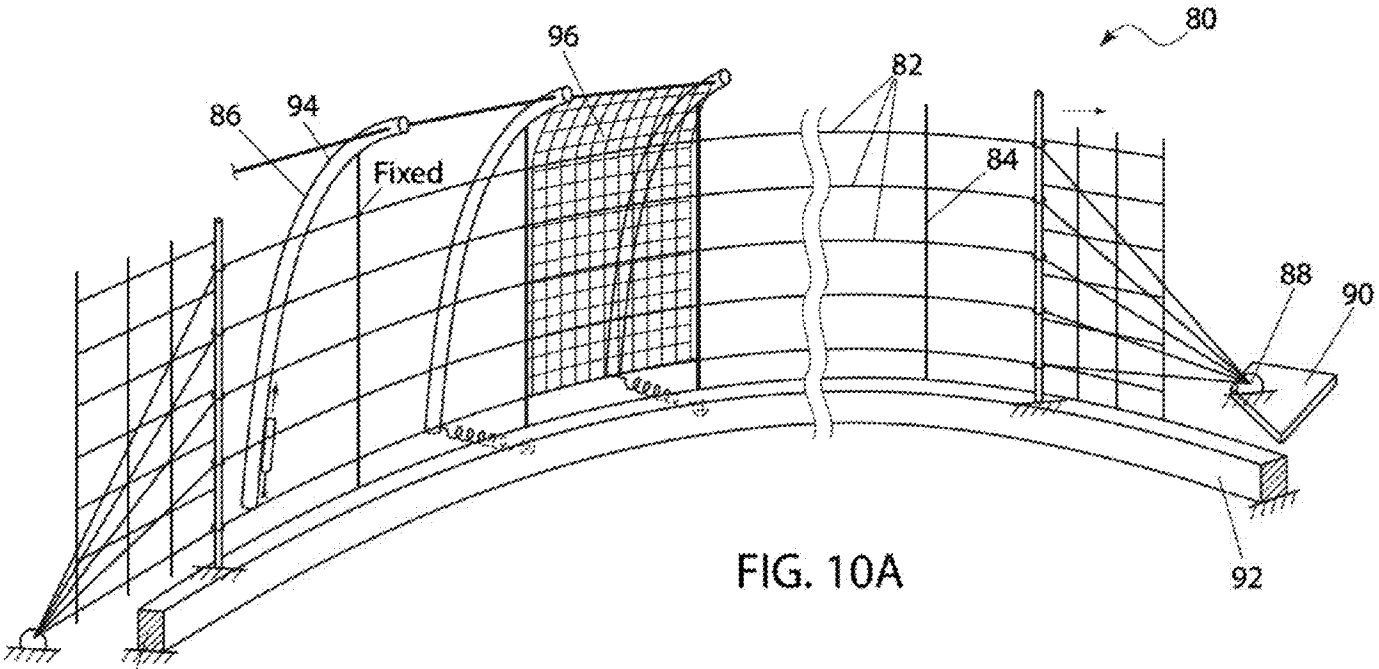
FIGS. 10-11 illustrate an alternate catch net embodiment.
Figure 10B:
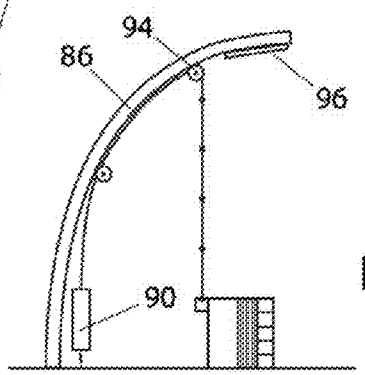
Figure 10C:
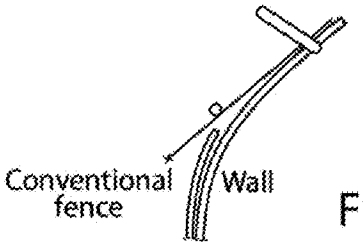
Figure 11:
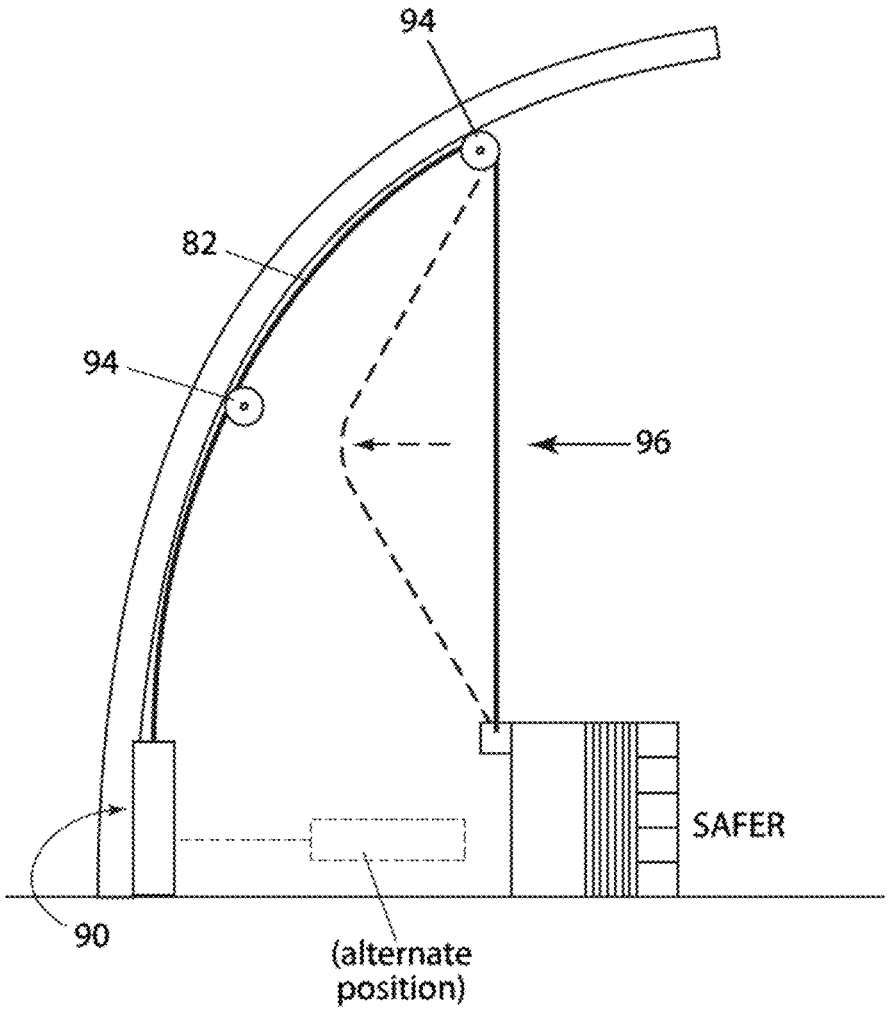
Figure 12:
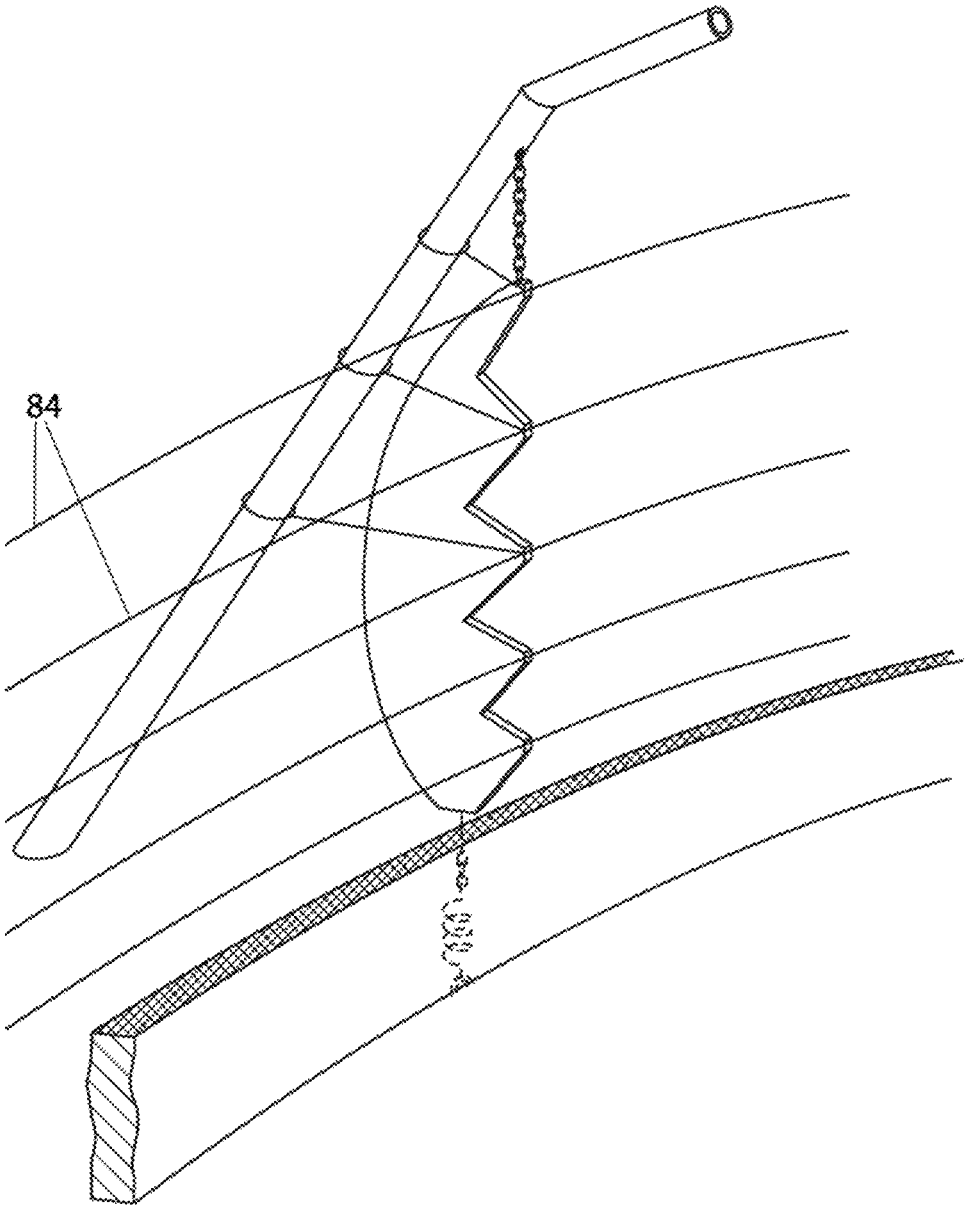
FIGS. 12-13 illustrate an alternate cable mount.

A further embodiment provides a catch net modification to the first embodiment shown above, but that provides a larger, less segmented system that addresses some of the issues identified with the first embodiment (such as net complexity, determining what happens between the net sections, post integrity, and runout distance issues). Examples of the catch net 80 are shown in FIGS. 10-11. Instead of a segmented net that would require joints between sections, the Catch Net 80 embodiment is installed along the entire length of a racetrack curve, as shown in FIG. 10A. The main horizontal safety cables 82 are supported by vertical cables 84 at each curved pole 86. Once the cables extend past the covered safety area, they are routed together and are terminated at each end 88 to an energy absorber 90. The vertical cables 84 are rigidly anchored at the bottom to the back of the track safety wall 92, and are routed through a pulley 94 at the top, then to an energy absorber 90 located at the base of the pole. A smaller mesh debris fence 96 may be integrated into the horizontal and vertical cables 82, 84, or it may be mounted along the curved support posts 86 at the back.

During a crash event, the Catch Net 80 system would flex and act like a web, deforming the most at the impact site. The energy absorbers 90 at each end of the main horizontal cables may be textile brakes, allowing for easy replacement in the event of a crash, although any appropriate form of energy absorber may be used. For example, the energy absorbers on the vertical cables may be smaller textile brakes or TZC units, depending on the energy absorber capacity required. In either case, replacement of the vertical energy absorbers may be made easy as well. Moreover, there may be enough flex in the main horizontal cables 82 that an energy absorber may not be required at each end 88, if at all.

Some benefits of this Catch Net 80 design are that it provides a relatively simple construction. There are not as many cables, pulleys and connection points as provided by the initial first embodiment. This solution also leverages a core competency of the developers by use of textile brakes or TZC (transition zone control) units. The cable system acts like a web, flexing most near impacts, but the system is also "active" at multiple points along the curve so that impacts from multiple cars could be absorbed. There are not any "mechanisms" or additional units required. The Catch Net deign also allows for built-in variability for different tracks and car sizes. The system could be mounted to the back of the SAFER barrier, or to the concrete retaining wall 92, or to both. (It should be understood that in an alternate embodiment, the system need not be mounted to the SAFER barrier, which could minimize the wall to pole distance.) ("SAFER" stands for Steel and Foam Energy Reduction, and such walls are installed along curves of automobile race tracks and are intended to absorb and reduce kinetic energy during the impact of an accident, and thus, lessen injuries sustained to drivers.) The net is also easy to reset between events—replacement of energy absorber packs or TZC units is all that is required, plus mesh repair, if needed.

In an alternate modification, it may be possible that only the bottom four or five horizontal cables are attached to an energy absorber 90. Additionally, the horizontal cable stretch may possibly be used as the energy absorber. It is also possible to adapt this solution so that it can also be installed on a straight section of track, as well if desired. FIG. 10B shows a side plan view of the catch net 80. FIG. 10C shows a top plan view of the catch net 80.

Alternate Cable Mount.

A fifth embodiment is an alternate cable mount. The alternate cable mount concept is an alternate method of connecting and aligning the horizontal safety cables of the system. It provides a method of spacing and holding the horizontal cables 82 that provides more clearance space between each cable and the mounting point. One benefit of this design is that the cable can be held away from its mounting structure somewhat, allowing space between cables for a car or driver to pass through in the event of an accident.

Figure 13A:
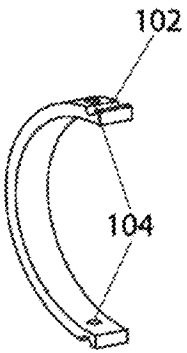
Figure 13:
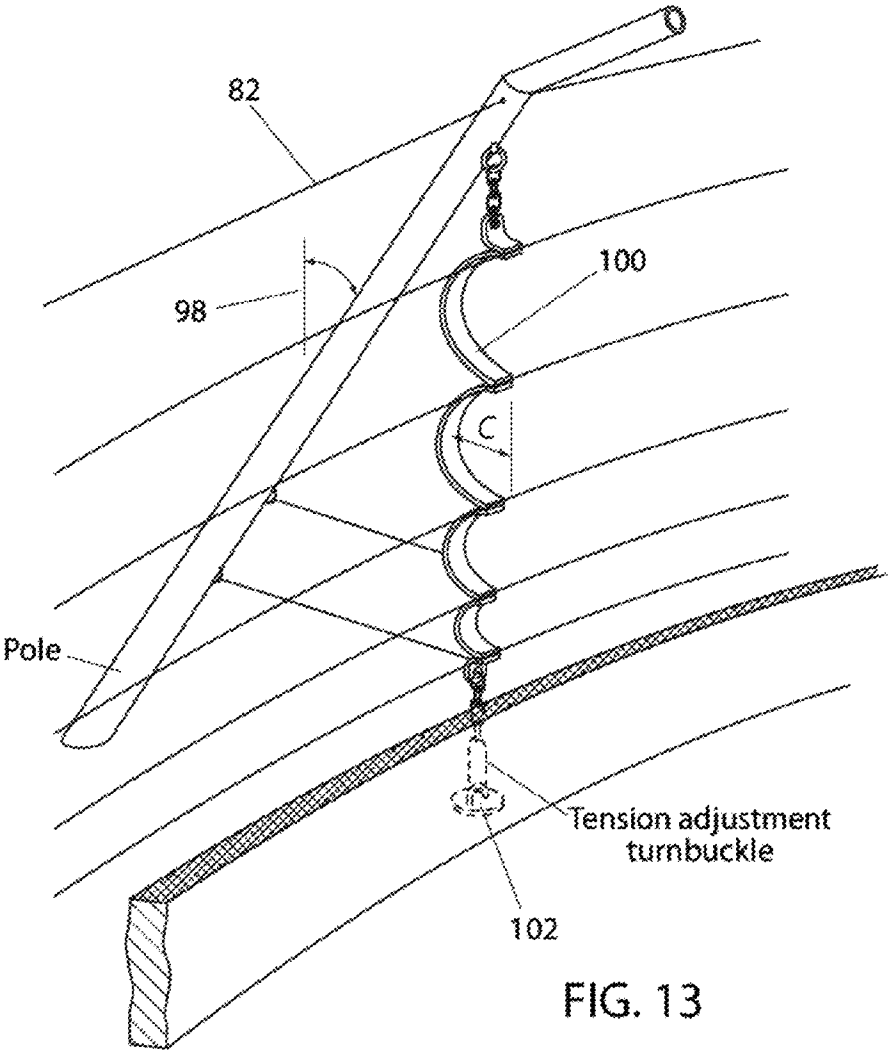

As shown in FIG. 13, an angled pole 98 secures a series of rolled or formed plates 100 or springs that are bolted together to act as cable spacer, while bolted to a ground or wall anchor 102 at the bottom. The purpose of the springs 100 is to support the main horizontal cables 82 and to provide clearance "C" between them in the event of a car striking the fence. The cables provided 82 between the angled pole 98 and springs 100 further prevent someone from standing between the springs and the pole. FIG. 13 also illustrates grooves 102 designed to accept cables. FIG. 13 further illustrates bolt holes 104 that may be used to secure one or more plate springs 100 together.

Pillow Spring Mounting Concept.

Figure 14A:
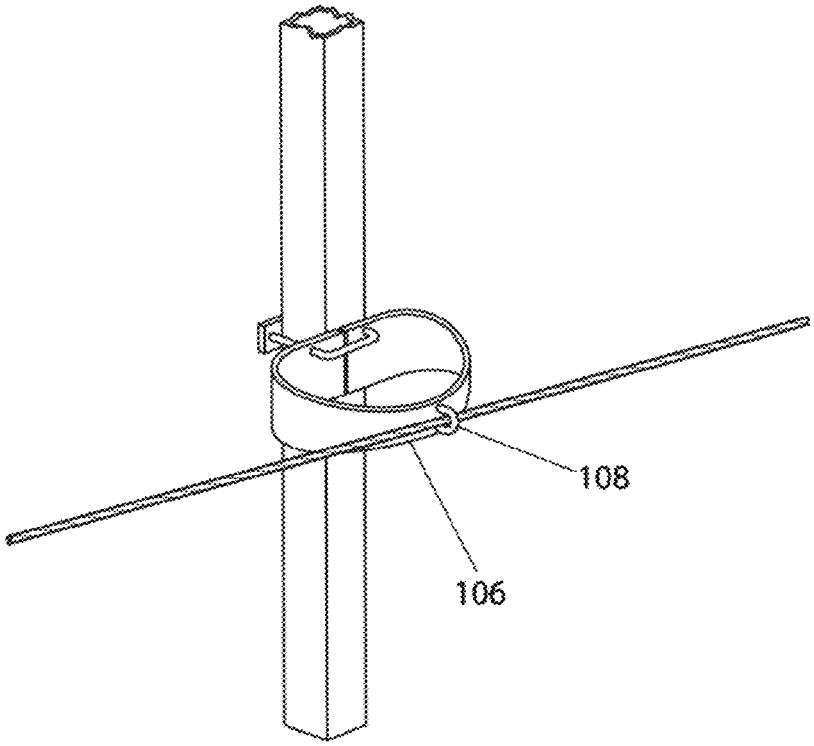
FIG. 14 illustrates a pillow spring mounting concept.
Figure 14B:
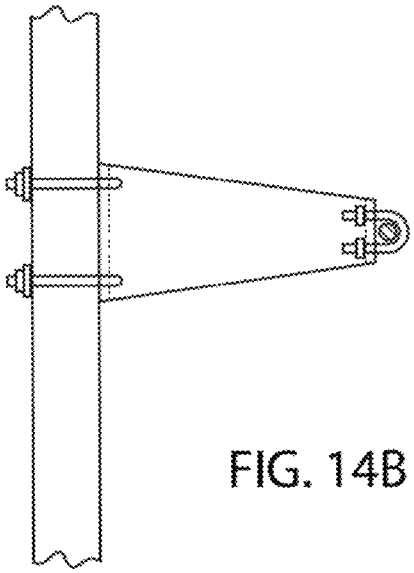

A further alternate the above alternate cable mount is the pillow spring mounting concept. The spring mounting concept provides a compliant mount for the cable held a distance away from the support post. An example is shown in FIG. 14. FIG. 14A illustrates a front perspective view. FIG. 14B illustrates a side view. The figure shows that a rolled plate 106 may be used as a pillow spring. A U-bolt 108 on the outside of the spring provides a cable guide. One of the benefits of this design is the reduction of the impact area between horizontal members.

Hydraulically Counteracted Pivoting Pole System.

Figure 15:
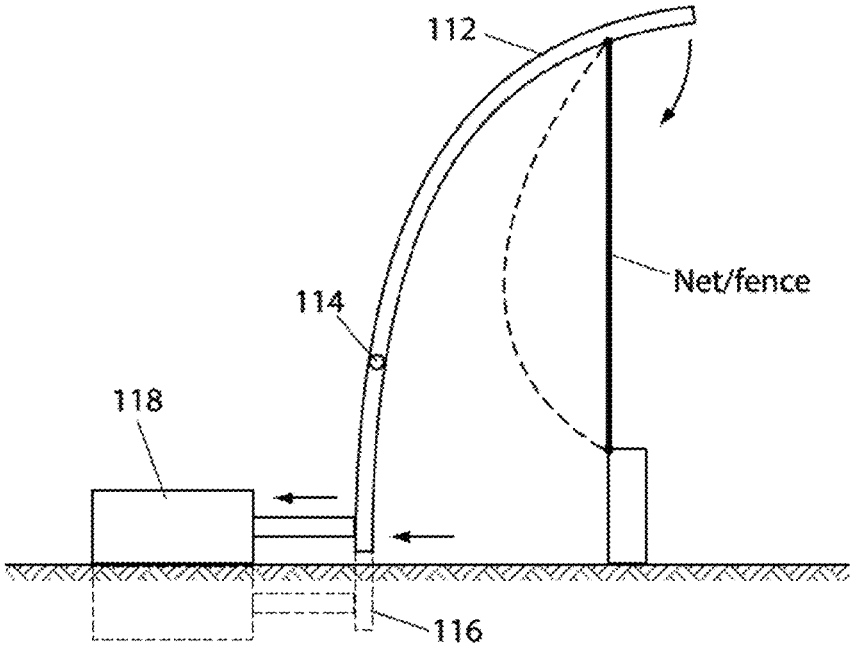
FIG. 15 illustrates a hydraulically counteracted pivoting pole system.

A further embodiment is the Hydraulically Counteracted Pivoting Pole System 110, shown in FIG. 15. This is a concept that involves using the poles to absorb the energy of a car leaving the track. The poles 112 are mounted on pivoting joints 114 at some height above the ground. The height may be determined based on the racetrack conditions or other safety testing or requirements. The bottom end 116 of the pole (which could be underground), is pivoted against a hydraulic cylinder 118 with extremely high pressure capability. The piston rod may be depressed by the bottom end of the pole, and the fluid in the system is compressed to absorb the energy of the arrestment. The hardware for this system may be mounted above or below ground.

Attach Net/Fence to SAFER Barrier Concept.

Figure 16:
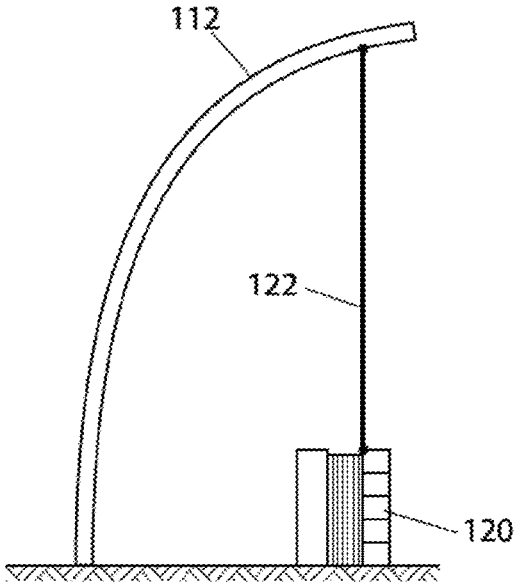
FIG. 16 illustrates an attachment of the net/fence to a SAFER barrier.

This concept provides an alternate mounting orientation of the net involving mounting the bottom edge of the safety net/fence system to the inside top edge of the SAFER Barrier. One example is shown in FIG. 16. In most instances, the SAFER barrier 120 consists of structural steel tubes welded together in a flush mounting, strapped in place to the existing concrete retaining wall. (Behind these tubes are bundles of closed-cell polystyrene foam, placed between the barrier and wall. The theory behind the design is that the barrier absorbs a portion of the kinetic energy released when a race car makes contact with the wall and dissipates the energy along a longer portion of the wall, reducing the impact energy to the car and driver, and preventing the car from propelling back into traffic on the racing surface.) The purpose of mounting the net 122 to the inside top edge of the SAFER barrier is to "borrow" some of the energy absorbing capacity of the existing SAFER Barrier and use it for dissipating the energy of a car hitting the fence above. It would also solve a potential problem of a car leaving the track and becoming tangled in the gap behind the SAFER Barrier, by closing-in the area in question with the lower edge of the fence. An additional benefit to mounting the net at this location is that an extra three feet (approximately) of runout could be added to the system by including the space above the foam cartridges and the wall as part of the fence system runout.

Large Textile Brake Concept.

Figure 17:
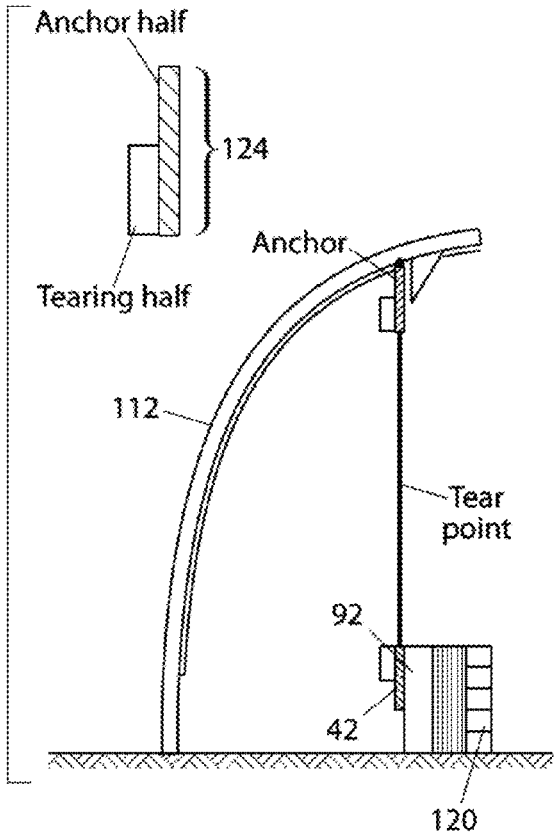
FIG. 17 illustrates a large textile brake concept.
Figure 17A:
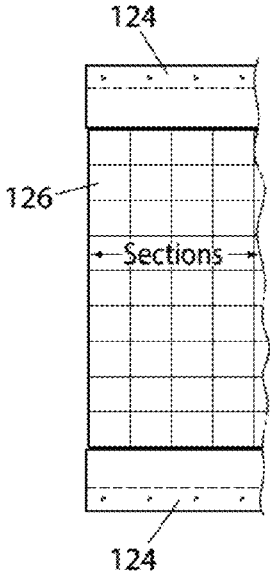

In this concept, a large, horizontal textile brake 124 is fastened to the pole structure 112 at the top, and to the concrete wall or SAFER barrier 120 at the bottom. An example is shown in FIG. 17. The net or fencing material 126 in this embodiment is made integral to the "tearing" side of the textile brake, so that if a car leaves the track and contacts the net, the textile brake would shear at the top and bottom to absorb the energy of the impact. Due to manufacturing limitations, the system may need to be made in sections, and the nets should be securely fastened to each other at net boundaries using any appropriate system or method. The system would be easy to reset after an impact, as a whole damaged section could be removed and replaced with a new one in a relatively short period of time. FIG. 17A shows the textile brake 124 positioned at the top and bottom of the net 126.

Pivoting Top Pole Section with Leaf Spring Energy Absorber Concept.

Figure 18:
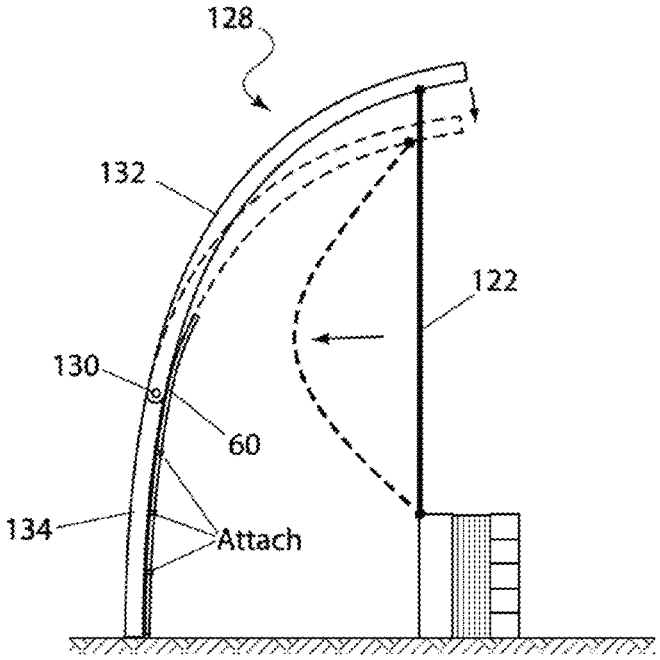
FIG. 18 illustrates a pivoting top pole section with a leaf spring energy absorber.

The pivoting top pole with leaf spring concept absorbing energy in the pole structure by providing a pivoting or flexible top portion of the pole. As shown in FIG. 18, in one embodiment, a two-part pole 128 is made with a pivoting joint 130 that allows the top portion 132 to pivot (or flex) relative to the fixed bottom portion 134. The net 122 or fence is rigidly fastened between the top movable portion of the pole and the fixed concrete wall below. A leaf spring 60 may be anchored at the bottom, and made to contact the top portion so that as the net deflects to absorb the energy of a crash, the top portion of the pole pivots and deflects downward. The leaf spring would then apply force to the top portion of the pole, absorbing the energy of the crash, and assisting in returning the system to the upright position. In use, a car may hit the net 122, causing the net to deflect inwardly, as shown. The top part 132 of the pole deflects downward. The leaf spring 60 absorbs energy and helps return the pole to the original position.

Large, Collapsible Airbag Concept.

Figure 19:
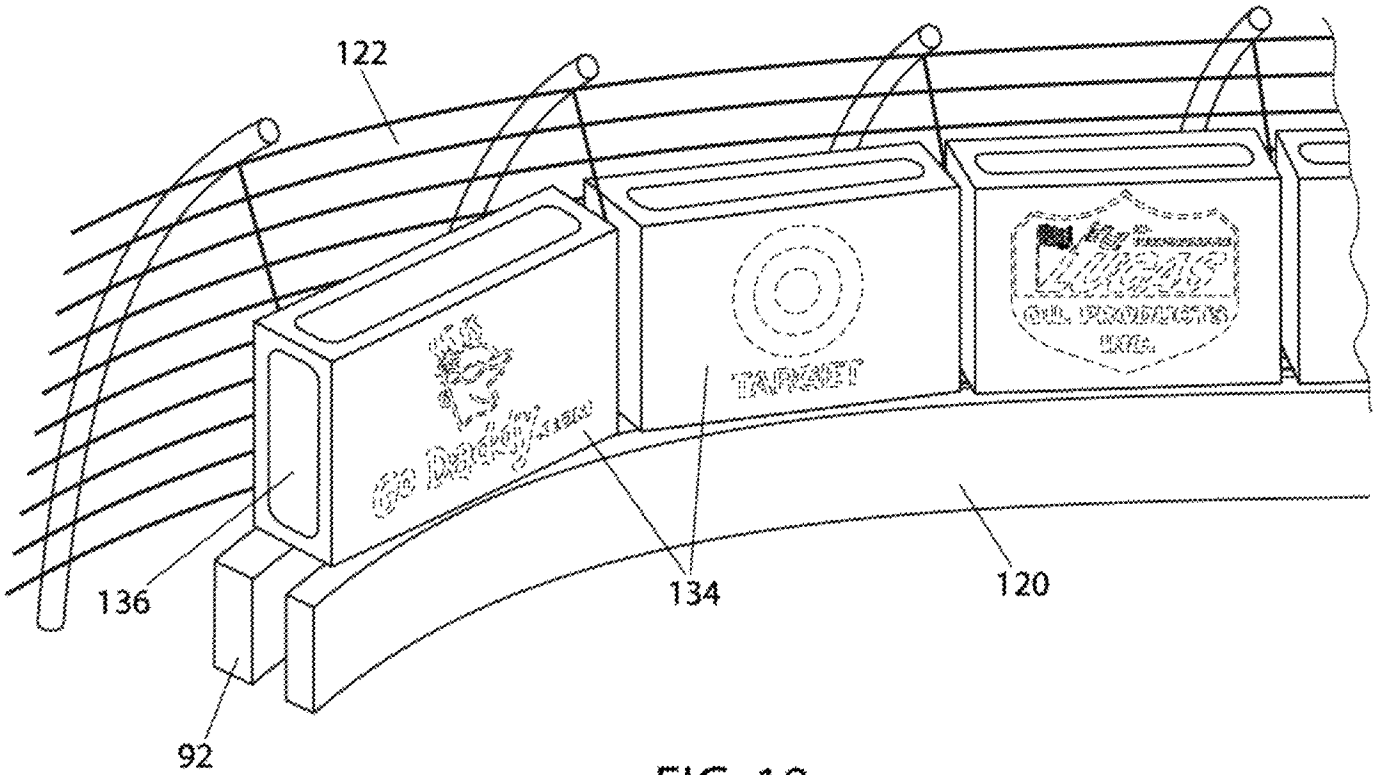
FIG. 19 illustrates a large, collapsible airbag.

For track installations with large catch fence areas that do not have spectator bleachers behind them, large, collapsible airbags 134 may be used to cushion the impact of cars leaving the track. Large, quick-deflating airbags could be installed above the SAFER barrier 120 that have flaps 136 that would break open upon impact and absorb the energy of a car hitting the bag 134. One example of such a configuration (prior to deployment of an airbag) is shown in FIG. 19. These airbags 134 may be similar to airbags used in the movie industry to cushion stunt performers from falls. The large vertical surface area of the bags could present an ideal spot for sponsor advertising as well.

Although multiple embodiments are described and provided above, it should be understood that other options may be designed that are considered within the scope of this invention. For example:

| No. | Idea Description |
|---|---|
| 1 | Tighter chain link fence |
| 2 | Chain link encased in plexiglass (like safety glass) |
| 3 | "Play knife" concept—compresses with pressure—pops back up |
| 4 | Extend SAFER barrier higher with clear tubes or panels (something like fiberglass) |
| 5 | Fence netting more like SAFER barrier |
| 6 | "Catcher's mitt" concept |
| 7 | Basic rigging |
| 8 | Rapid vertically deploying net based capture system |
| 9 | Hydraulically counteracted pivoting pole system |
| 10 | Tie existing cables into a modified cable arrestor system |
| 11 | Ballistic netting/fencing release attached to energy absorbers |
| 12 | Multilayered approach—clear plexiglass and SAFER barrier w/spider web net and energy absorber |
| 13 | Giant curtains (like plastic refrigerator curtains) |
| 14 | Giant Air Blower/Air Knife |
| 15 | Vertical links—transparent super fibers |
| 16 | C-shaped fence design |
| 17 | Use large airbags along areas without spectators (w/advertising?) |

-continued

| No. | Idea Description |
|---|---|
| 18 | Nylon tapes with memory capability |
| 19 | Chinese finger cuffs |

Changes and modifications, additions and deletions may be made to the structures and methods recited above and shown in the drawings without departing from the scope or spirit of the invention and the following claims.

What is claimed is:

1. A catch fence for halting the overrun of a car leaving a racetrack, comprising:

(a) at least two pivotable poles, each pole comprising a pivot point along the pole or at a pole base;

(b) each of the at least two pivotable poles comprising a vertical cable extending between an upper and a lower portion of each pivotable pole;

(c) a plurality of cables extending between the at least two pivotable poles, each cable in the plurality of cables having one end suspended from the vertical cable of one of the pivotable poles and another end suspended from the vertical cable of the other of the pivotable poles; and (d) at least one portion of a net or fencing installed between the poles, supported by the plurality of cables.

2. The catch fence of claim 1, wherein at least an upper portion of the pivotable pole is C-shaped in a longitudinal dimension.

3. The catch fence of claim 1, wherein the pivot point is provided at the base of the pole by a torsion spring or hydraulic cylinder positioned at each pivot point joint.

4. The catch fence of claim 1, wherein the plurality of cables are mounted to the vertical cables via a leaf spring.

5. The catch fence of claim 1, wherein the pivot point is along the pole, allowing only a portion of the pole above the pivot point to pivot.

6. A catch fence for halting the overrun of a car leaving a racetrack, comprising:

(a) at least two angled poles; and (b) a plurality of cables extending between the at least two angled poles, the cables supported via a plurality of forwardly positioned rolled plates secured together and extending from an upper pole portion to a ground anchor, wherein at least a portion of at least one of the cables of the plurality of cables is supported at a joint between at least two rolled plates.

7. The catch fence of claim 6, wherein the rolled plates function as a pillow spring.

8. The catch fence of claim 6, wherein the rolled plates comprise grooves configured to accept the cables.

9. A catch fence system for halting the overrun of a car leaving a racetrack, comprising:

(a) at least two curved poles; and (b) at least one portion of a net or catch fence for halting the overrun of the car leaving the racetrack extending from a top portion of each pole and secured to a Steel and Foam Energy Reduction barrier, further comprising a textile brake having a first end fastened to at least one of the at least two curved poles and a second end fastened to the Steel and Foam Energy Reduction barrier.

10. A catch fence for halting the overrun of a car leaving a racetrack, comprising:

(a) curved or straight main support poles, each of the support poles comprising a pulley configured to route and support a vertical support cable;

(b) a plurality of vertical support cables at each pole secured to a wall or secured to a Steel and Foam Energy Reduction barrier at a cable bottom, routed through the pulley of each pole, and routed back down to an energy absorber at a base of each pole;

(c) a plurality of horizontal cables extending across and supported by the vertical support cables, the horizontal cables terminating at a collective fixed point together or being collectively connected to an energy absorber at cable ends;

(d) at least one vertical cable of the plurality of vertical cables and at least one horizontal cable of the plurality of horizontal cables fastened together; and (e) an integral mesh debris fence fastened to the horizontal and vertical cables.

* * * * *